United States Patent [19]

Molyneux

[11] 3,970,248

[45] July 20, 1976

[54] COMBINED RAIL CLIP AND ANCHORAGE

[76] Inventor: George Molyneux, Eastbrook Road, Gloucester, England

[22] Filed: Oct. 24, 1974

[21] Appl. No.: 517,605

Related U.S. Application Data

[63] Continuation-in-part of Ser. No. 396,303, Sept. 11, 1973, abandoned.

[30] Foreign Application Priority Data

Sept. 12, 1972 United Kingdom ..... 42287/72

[52] U.S. Cl. ..... 238/349

[51] Int. Cl.[2] ..... E01B 9/30

[58] Field of Search ..... 238/310, 315, 321, 349, 238/343

[56] References Cited

UNITED STATES PATENTS

| | | | |
|---|---|---|---|
| 2,533,055 | 12/1950 | Schulze | 238/349 |
| 3,658,246 | 4/1972 | Davies | 238/349 |

FOREIGN PATENTS OR APPLICATIONS

| | | | |
|---|---|---|---|
| 657,980 | 3/1938 | Germany | 238/349 |

*Primary Examiner*—M. H. Wood, Jr.
*Assistant Examiner*—Richard A. Bertsch
*Attorney, Agent, or Firm*—Young & Thompson

[57] ABSTRACT

A combined rail clip and anchorage for holding down a flanged track rail has a resilient clip of U-shaped or cranked form, the end of one arm of which will bear down on the rail flange and the other arm will be received in a passageway in the anchorage. A stepped tip to the one arm will lock behind the end of the passageway when the clip is pressed fully home.

In one arrangement both arms are directed towards the rail flange and received within the anchorage, whereas in another arrangement the one arm of the clip lies over the flange, and the other being held in the anchorage passageway to lie alongside the longitudinally extending rail flange.

23 Claims, 16 Drawing Figures

COMBINED RAIL CLIP AND ANCHORAGE

This application is a continuation-in-part of copending application Ser. No. 396,303, filed Sept. 11, 1973 and now abandoned.

This invention is concerned with clips which are held down on a supporting surface by an anchorage and locate and hold a flanged track rail on the supporting surface.

Many previous constructions of this type are known, but on the whole they are relatively intricate, particularly where the shape of the rail clip is concerned, and it is an object of this invention to provide a fairly simple yet effective form of rail clip and anchorage and which is moreover readily applicable for use with track rails used as electrical conductors.

Broadly, the invention consists in a combination of a rail clip and anchorage for holding down a flanged track rail onto a supporting surface, wherein the anchorage is provided with mounting means whereby it may be secured to the supporting surface and with a passageway to receive one arm of a U-shaped bar, of resilient yet sturdy material forming the rail clip, such that a surface of the other arm of the bar will be caused to bear down onto the flange of the track rail, cooperating locking means being provided between the anchorage and the rail clip to resist withdrawal of the clip when the one arm of the bar is inserted into the passageway to a locking position.

In one preferred embodiment, the passageway is positioned so that the ends of the rail clip will be directed towards the rail flange. This embodiment is preferably so constructed that the end portion of the other arm has a flattened surface to bear down on the flange of the track rail and a taper tip leading to the flat surface.

Ideally, the other arm is also received in a passageway in the anchorage, preferably another passageway, although one passageway in the anchorage may be constructed to receive both arms. As a preferred form of locking means, the end portion of the other arm has a stepped region arranged to snap behind the end of the passageway.

It is desirable that, as means for biassing the two arms towards each other, and thus biassing the other arm onto the rail flange, the surface of the passageway which cooperates with the other arm is angled towards the surface of the passageway which cooperates with the one arm in the direction of insertion of the rail clip.

In another preferred embodiment, the passageway is positioned so that the arms of the bar will lie substantially in the same direction as the rail flange, and ideally the passageway is angled in the direction towards the mounting means from the entrance of the passageway, so that a biassing force will be produced by the other arm onto the rail flange. The locking means may be achieved by arranging that the end portion of the one arm has a stepped region arranged to snap behind the end of the passageway. Preferably, the end portion of the one arm is extended such that the extension will project beyond the end of the passageway in the locking position since this equal to or greater than the passageway length, since this allows the clip to be inserted and removed from the anchorage without the use of a special tool.

In all embodiments it is preferred that the rail clip is formed of spring metal. The or each passageway can be a bore extending throughout the thickness of the anchorage, and in this case the mounting means is advantageously a rod depending from the anchorage to be secured in the supporting surface. Alternatively, the or each passageway may be defined by holes in facing walls of an anchorage which is formed from a channel section, preferably of U-shaped cross-section. In this instance, the mounting means can be provided by the end of the channel section being formed with portions situated outside the plane of the walls thereof, which will prevent withdrawal when set in concrete, etc.

Where the track rail to be held is to be an electrical conductor, an insulating plate may be provided for location over the flange of the track rail, and to receive the bearing surface of the one arm. Preferably, the insulating plate will be provided with lugs to cooperate with the anchorage and prevent relative lateral movement thereto.

The invention may be performed in various ways, and preferred embodiments thereof, will now be described, by way of example only, with reference to the accompanying drawings, in which.

Figure 1:
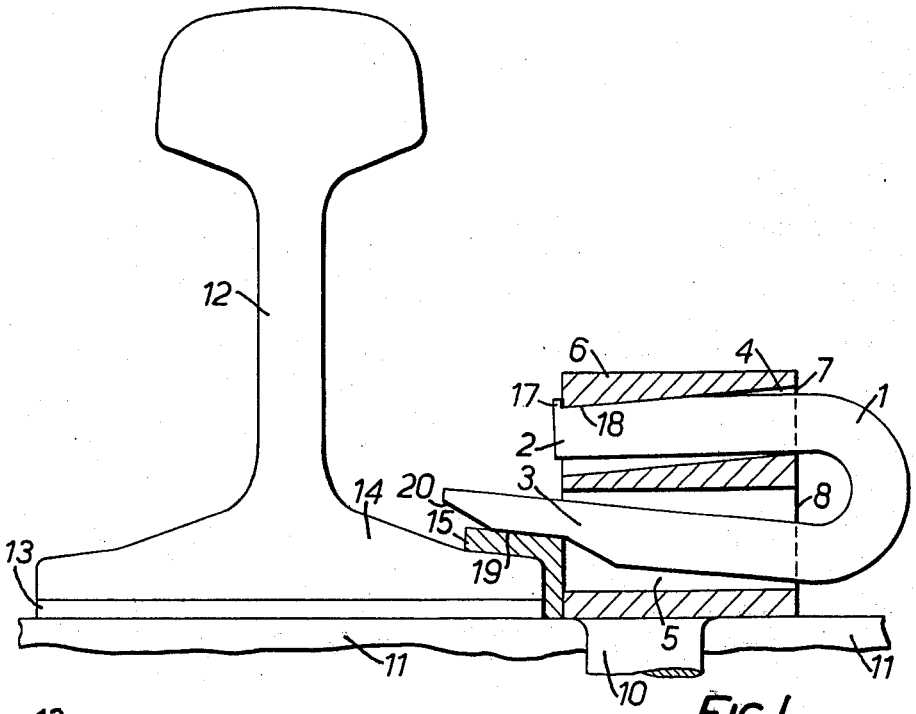
FIG. 1 is a partial cross-section through a rail clip and anchorage unit constructed in accordance with the invention.
Figure 2:
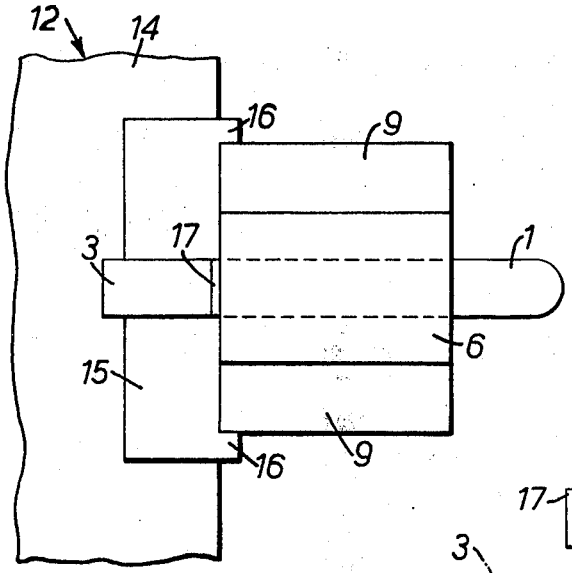
FIG. 2 is a plan view of the unit shown in FIG. 1.
Figure 3:
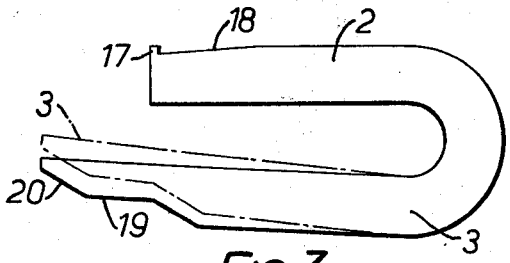
FIG. 3 is a side view of the rail clip of FIG. 1, indicating the normal and stressed states thereof.
Figure 4:
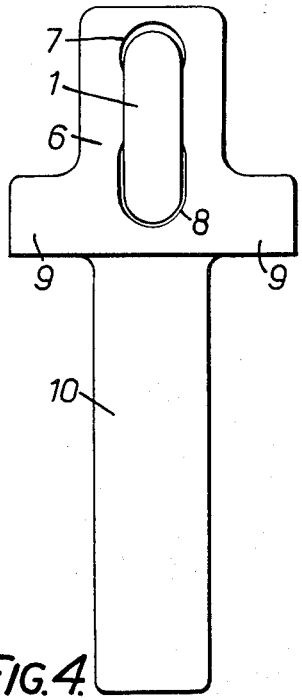
FIG. 4 is a rear end view of the unit shown in FIG. 1.
Figure 5:
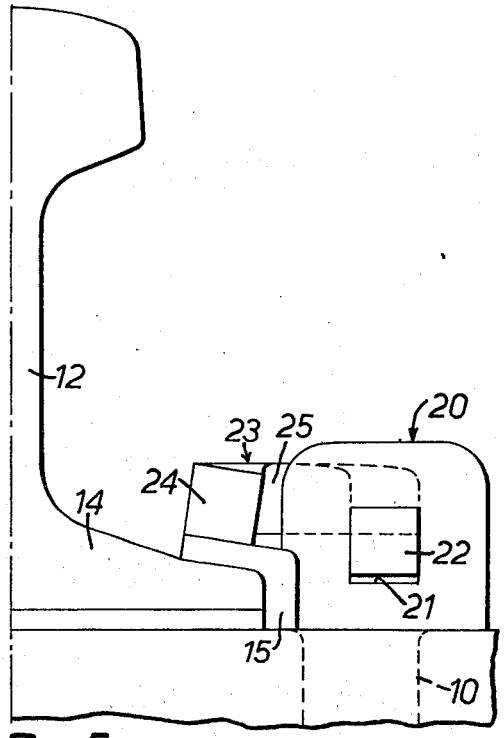
FIG. 5 is an end view of an alternative rail clip and anchorage unit constructed in accordance with the invention.
Figure 6:
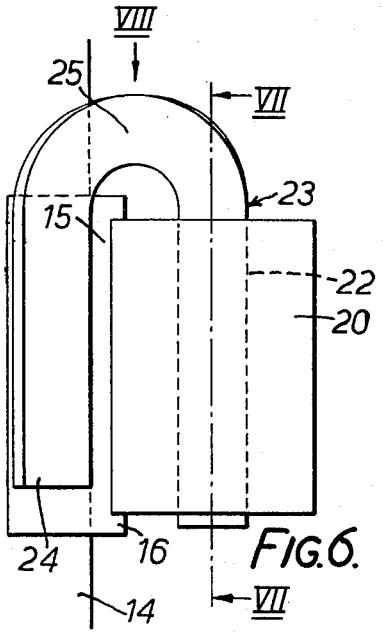
FIG. 6 is a plan view of the unit shown in FIG. 5.
Figure 7:
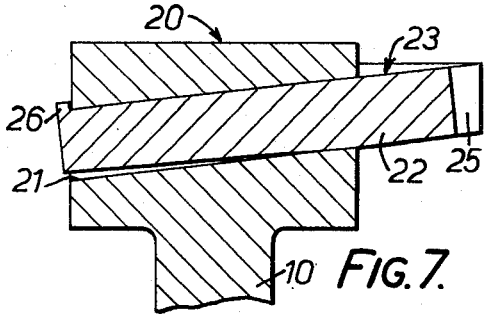
FIG. 7 is a vertical cross-section on line VII—VII of FIG. 6.
Figure 8:
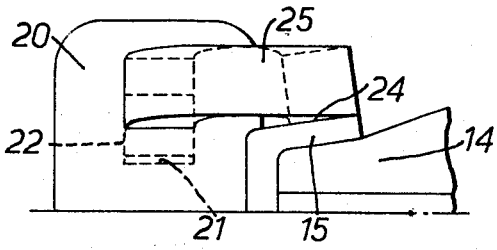
FIG. 8 is an end view of the unit in the direction of the arrow VIII of FIG. 6.

Referring firstly to FIGS. 1 to 4, the rail clip 1, formed from a resilient metal, such as EN 45 silicomanganese steel, is generally U-shaped, with the two arms 2, 3 thereof tapering slightly towards one another at their free ends, as indicated in full lines in FIG. 3. These two arms 2, 3 respectively pass through bores 4, 5 in a precast anchorage 6. The bore 5 passes substantially straight through the anchorage 6 from the entrance 8, but the other bore 4 is directed downwardly from the entrance 7 at the rear end of the anchorage and also tapers fractionally in the same direction. Thus, for instance, the diameter of the bore 4 at the entrance 7, may be 13/16 inch while, at the other end the diameter is 11/16 inch, the diameter of the bar forming the rail clip 1 being 10/16 inch.

The anchorage 6 has lateral flanges 9 and a depending rod 10 which will be set into the ground 11 where a rail 12 is to be fixed. This rod 10 may have one or more projections or indentations formed thereon to provide gripping surfaces, when the rod is set in concrete or other material, to resist removal.

The rail 12 in this instance is to be an electrical conductor for supplying electrified trains, and is therefore set on an insulating plate 13. The edge of the flange 14, where the anchorage 6 is to abut it, is provided with an insulating plate 15, passing around the edge of the flange 14, and also extending on either side of the flanges 9 to form locating lugs 16 as shown in FIG. 2. The insulating plates 13, 15 can, for instance, be formed of an insulating plastics material.

It will be seen that the end of arm 2 of the rail clip 1 has a stepped tip 17 (about 1/16 inch deep), formed by flattening the bar forming the rail clip, just behind the tip 17 to form the flat top surface 18. Also the underneath surface of the arm 3 is flattened to form the flat area 19 just behind the angled taper 20 formed at the tip of the arm 3.

To secure the rail 12, by means of the rail clips 1, firstly each anchorage 6 is fixed in the ground 11 at relevant positions and the rail 12 is situated (on the insulating plate 13) adjacent the anchorage 6, with the insulating plates 15 between the flange 14 and each anchorage 6. The ends of the arms 2, 3 of a rail clip 1 are then introduced into the respective bores 4, 5 and are moved inwardly until the taper 20 at the tip of the arm 3 begins to ride up the insulating plate and at the same time the stepped tip 17 at the end of the arm 2 contacts the top of the tapering bore 4. Further movement of the rail clip 1 in the same direction causes the rail clip to deform until, when it has been forced fully home, the tip 17 snaps over the inner end of the bore 4 (as shown in FIG. 1) and, with the flat area 19 of the arm 3 bearing down on the insulating plate 15, the rail clip is stressed in the position indicated by the dashed outline for the arm 3 in FIG. 3.

The rail clip 1 can be formed simply from a metal bar by bending it into the U-shape and beating the ends to form the tip 17 and flat 18, and the flat area 19 and taper tip 20. The flat area 19 provides a good surface contact of the rail clip onto the insulating plate 15, thus providing a significant frictional resistance to longitudinal movement of the rail 12. Also the length of the bar forming the rail clip 1 between the bearing surfaces 18 and 19 gives good resilience characteristics. Another characteristic of the whole arrangement is that the closeness of the case metal anchorage 6 to the rail 12 resists possible lateral buckling of the rail. Of even greater significance is the fact that the proximity of the end of the arm 3 of the spring clip 1 to the top of the bore 8 greatly resists excessive longitudinal buckling of the rail 12, since the complete anchorage becomes involved in resisting this buckling, as the surfaces of the arm 3 and the bore 8 contact one another. Many clips rely solely upon the resilience of the spring itself and this may not be sufficient under conditions of severe stress. This feature applies also to resistance to longitudinal movement of the rail 12, since the arm 3 of the spring clip 1 will contact, and be held by the sides of the bore 8, as the arm 3 is caused to move.

Although separate bores 4, 5 are preferred through the anchorage 6, a single bore to receive both arms 2, 3 of the rail clip can of course be provided. Obviously, the rail clip and anchorage can be used with weight bearing rails, rather than the electrified conductor rails 12, in which case, of course, the insulating plates 13 and 15 would not be required, but the dimensions of the anchorage in particular would have to be modified to ensure that the flat area 19 bears directly onto the flange 14.

The stepped tip 17 could obviously be formed in different ways and can be located behind a ledge formed in the bore 4, if desired. As a further modification, the angling of the bore 4 downwardly could be avoided by forming the tapering towards one another of the arms 2, 3 of the rail clip 1 in a more pronounced manner. It will also be appreciated that mounting means such as bolts or the like could replace the integral rod 10 on the anchorage 6.

The unit shown in FIGS. 5 to 8 comprises a precast anchorage 20, provided with a single bore 21 to receive one arm 22 of a rail clip 23 in a direction parallel to the flange 14 of the rail 12. The other arm 24 of the U-shaped, square-cross-section rail clip 23 lies along the rail flange 14 and is biassed down onto an insulating plate 15 by the tension produced in the curve 25 of the clip 23 as the arm 22 is forced down the declining bore 21. A retaining lug 26 on the end of the arm 24 snaps into engagement with the end of the bore 21 when the clip is pushed fully home to prevent accidental disengagement. As with the first embodiment, the plate 15 has locating lugs 16 and the anchorage 20 is provided with a mounting rod 10 to be secured in the ground, concrete base, etc.

Figure 9:
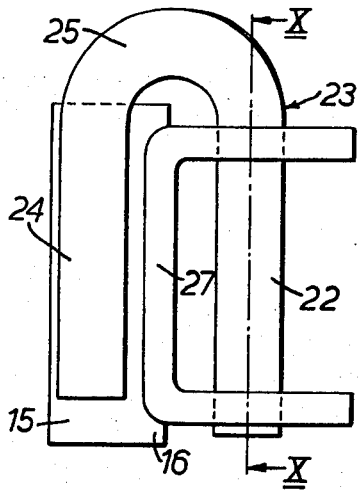
FIG. 9 is a plan view of a third rail clip and anchorage unit constructed in accordance with the invention.
Figure 10:
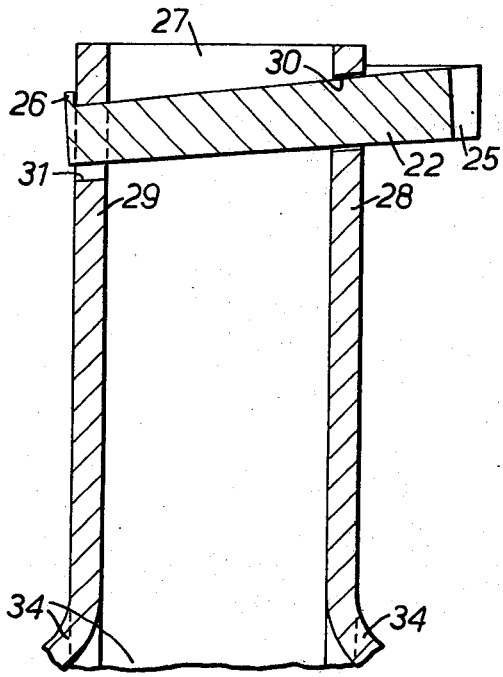
FIG. 10 is a vertical cross section on line X—X of FIG. 9.
Figure 11:
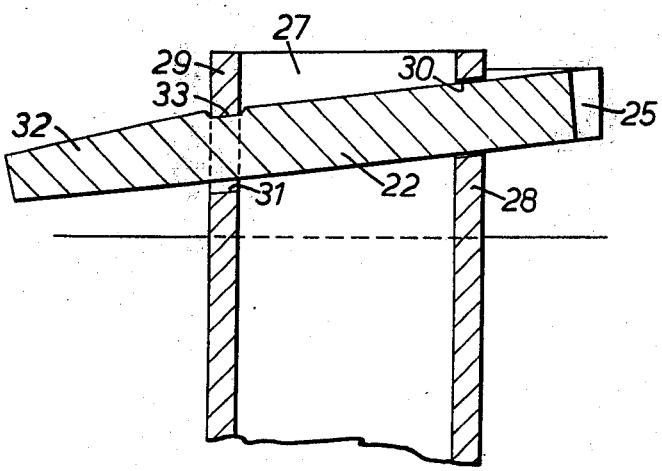
FIG. 11 is a cross-sectional view similar to FIG. 10, but illustrating a modification.

A modified arrangement to that of FIGS. 5 to 8 is shown in FIGS. 9 and 10, wherein the clip 23 is basically identical, but the anchorage is in the form of a U-shaped channel section, 27. The facing walls 28, 29 of the section 27 are provided with holes 30, 31 respectively, which define an inclined passageway for the receipt of the arm 22 of the clip 23. A special tool is needed to force the end of the arm 22 down into the hole 31, but once there, the lug 26 locates behind the hole 31 to fix the rail clip and provide the desired tension in the curve 25. A tool will not be necessary if the end of the arm 22 is formed with an extension 32 (FIG. 11) which will enter the hole 31 before any tension is applied to the curve 25 and a stepped groove 33 locates with the edge of the hole 31 to secure the clip in position. The ends 34 (FIG. 10) of the section 27 are formed with ragged portions which will key into concrete, etc., to secure the anchorage 27.

Figure 12:
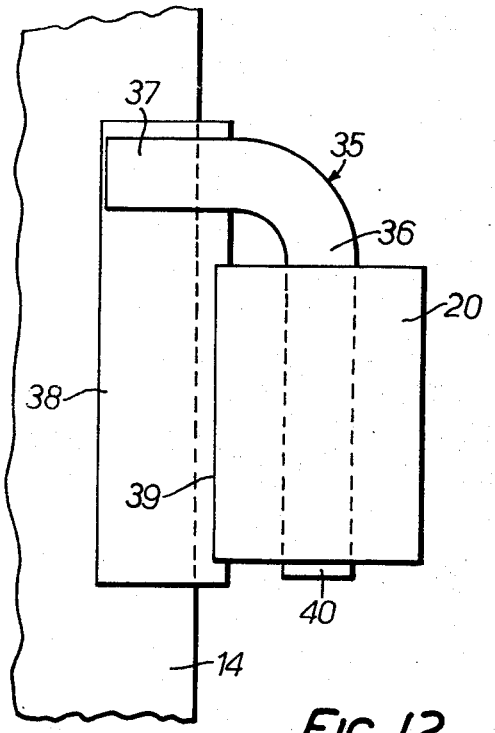
FIG. 12 is a plan view of a further modification.

In the embodiment shown in FIG. 12 the anchorage 20 holds a modified form of rail clip 35 which is of L-shape, the longer arm 36 being received in the bore of the anchorage (in a similar manner to that illustrated in FIG. 7) and the shorter arm 37 is directed at right angles over the rail flange 14. In this instance an insulating plate 38 (similar to that shown in FIGS. 4 and 5) is mounted over the rail flange 14, and has a cut-out portion 39 which locates over the edge of the anchorage 20 to prevent lateral movement of the plate 38. As in the other embodiments the arm 36 of the clip has a retaining lug 40.

Figure 13A:
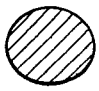
FIGS. 13A–13D illustrate alternative cross-sectional shapes for the rail clips which may be utilized in the embodiments shown in FIGS. 5–12.
Figure 13B:
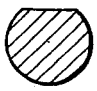
Figure 13C:
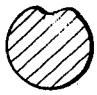
Figure 13D:
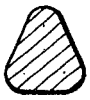

In all the embodiments shown in FIGS. 4 to 12, one arm portion of the rail clip will be received in the passageway in the anchorage and another arm portion is located over the rail flange. The reaction between the rail flange and the other arm portion causes a turning moment to be exerted on the arm portion in the passageway. This turning moment is resisted in the embodiment shown in FIG. 4, by forming the rail clip (or at least the portion thereof passing through the passageway) in a square cross-sectional shape, the passageway having a similar cross section. Resistance to the turning moment can be achieved by various other complementary shapes for the passageway and the arm portion of the rail clip received therein. Examples of such shapes are illustrated in FIG. 13; FIG. 13A shows an oval cross section; FIG. 13B illustrates an essentially circular cross section with a flattened portion; in FIG. 13C an indentation has been formed in a member of generally circular cross section; and FIG. 13D illustrates a basically triangular cross section. The cross-sectional shapes illustrated can be formed from a bar having an initial circular cross section with varying degrees of ease. Generally speaking, however, rail clips of the various forms illustrated in FIGS. 4 to 13 can be manufactured without significant difficulty and compare very favorably with the rail clips of the prior art which are of intricate shape.

It should be noted, in some instances, it is advantageous to provide a plate similar to the plates 15 and 38 shown in certain figures of the drawings, even though the rail is not to be electrified. In such cases, of course, the plate need not be formed of an electrically insulating material, but rather of a material suited to another particular purpose.

Having described my invention, I claim:

1. A combination of a rail clip and anchorage for holding down a flanged track rail onto a supporting surface, wherein said rail clip comprises a substantially U-shaped bar of resilient yet sturdy material providing two arms and said anchorage is provided with mounting means whereby it may be secured to said supporting surface and is formed to define a passageway to receive one arm of said bar and engaging both top and bottom surfaces of said arm at spaced positions in such a way that said one arm is restrained against tilting movement and both said arms will be directed towards said rail flange, such that a bearing surface of the other arm of said bar, situated below the one arm, will be caused to bear down onto the flange of said track rail, cooperating locking means being provided between said anchorage and said rail clip to resist withdrawal of said clip when said one arm of said bar is inserted into said passageway to a locking position and including means for restraining pivotal movement of said rail clip about the longitudinal axis of said passageway.

2. The combination according to claim 1 wherein the end portion of said one arm has a stepped region arranged to snap behind the end of the passageway in which it is received to form said locking means.

3. The combination according to claim 1 wherein the end portion of said other arm has a flattened surface to bear down on the flange of said track rail and a taper tip leading to said flat surface.

4. The combination according to claim 1 wherein a further passageway is defined in said anchorage for receiving said other arm.

5. A combination according to claim 1 wherein said passageway is inclined downwardly towards said rail, whereby the two arms of said bar are forced towards each other when said clip is inserted into said anchorage, and said clip is thereby stressed to exert a downward spring force on said flanged rail track.

6. A combination of a rail clip and anchorage for holding down a longitudinally extending flange of a track rail onto a supporting surface, wherein said rail clip comprises a substantially U-shaped bar of resilient yet sturdy material providing two arms and said anchorage is provided with mounting means whereby it may be secured to said supporting surface and is formed to define a passageway extending substantially parallel with the length of said track rail to receive one arm of said bar, such that a bearing surface of the other arm of said bar will be caused to bear down onto the flange of said track rail, cooperating locking means being provided between said anchorage and said rail clip to resist withdrawal of said clip when said one arm of said bar is inserted into said passageway to a locking position.

7. A combination according to claim 6 wherein the passageway is angled in the direction towards the mounting means from the entrance of the passageway.

8. A combination according to claim 6 wherein said one arm has an end portion providing a stepped region arranged to snap behind the end of the said passageway, to form said locking means.

9. A combination according to claim 6 wherein said end portion of said one arm is extended to form an extension which will project beyond the end of said passageway in the locking position.

10. A combination of a rail clip and anchorage for holding down a longitudinally extending flange of a track rail onto a supporting surface, wherein said rail clip comprises an L-shaped bar of resilient yet sturdy material providing two arm portions extending in perpendicular directions and said anchorage is provided with mounting means whereby it may be secured to said supporting surface and is formed to define a passageway to receive one arm portion of said bar, such that a bearing surface of the other arm portion of said bar will be caused to bear down onto the flange of said track rail in such a manner as to create a turning moment on said one arm portion, said one arm portion and said passageway being formed with cooperating locking formations so as to resist such turning moment, cooperating locking means being provided between said anchorage and said rail clip to resist withdrawal of said clip when said one arm portion of said bar is inserted into said passageway to a locking position.

11. A combination according to claim 10 wherein said one arm portion is of non-circular cross-section and said passageway is of corresponding non-circular cross-section.

12. A combination according to claim 10 wherein the passageway is angled in the direction towards the mounting means of the anchorage from the entrance of the passageway.

13. A combination according to claim 10 wherein an insulating plate is provided for location over the flange of said track rail, and to receive said bearing surface of said other arm portion.

14. A combination according to claim 10 wherein the anchorage is formed from a channel section providing facing walls and said passageway is defined by holes in said facing walls of the anchorage.

15. A combination according to claim 14 wherein said channel section is of U-shaped cross section.

16. A combination according to claim 14 wherein the end of said channel section has portions situated outside the plane of the walls thereof to provide said mounting means.

17. A combination of a rail clip and anchorage for holding down a longitudinally extending flange of a track rail onto a supporting surface, wherein said rail clip comprises a substantially U-shaped bar of resilient yet sturdy material providing two arms and said anchorage is provided with mounting means whereby it may be secured to said supporting surface and is formed to define a passageway extending substantially parallel with the length of said track rail to receive one arm of said bar, such that a bearing surface of the other arm of said bar will be caused to bear down onto the flange of said track rail, cooperating locking means being provided between said anchorage and said rail clip to resist withdrawal of said clip when said one arm of said bar is inserted into said passageway to a locking position wherein the anchorage is formed from a channel section having two spaced walls and said passageway is defined by holes in said spaced walls of the channel section.

18. A combination according to claim 17 wherein said channel section is of U-shaped cross section.

19. A combination according to claim 17 wherein the end of said channel section has portions situated outside the plane of the walls thereof to provide said mounting means.

20. A combination of a rail clip and anchorage for holding down a longitudinally extending flange of a track rail onto a supporting surface, wherein said rail clip comprises a substantially U-shaped bar of resilient yet sturdy material providing two arms and said anchorage is provided with mounting means whereby it may be secured to said supporting surface and is formed to define a passageway to receive one arm of said bar, such that a bearing surface of the other arm of said bar will be caused to bear down onto the flange of said track rail, and in which said passageway if inclined downwards towards said supporting surface; whereby as said first arm is inserted into said passageway, said second arm is caused to exert an increasing downward spring force on said track rail, and including means for restraining pivotal movement of said rail clip about the longitudinal axis of said passageway.

21. A combination according to claim 20, wherein said passageway in said anchorage is formed to engage both top and bottom surfaces of said one arm of said bar, at spaced positions, whereby said one arm is restrained against tilting movement.

22. A combination of a rail clip and anchorage for holding down a longitudinally extending flange of a track rail onto a supporting surface, wherein said rail clip comprises an L shaped bar of resilient material providing two arms extending in perpendicular directions, and said anchorage is provided with mounting means whereby it may be secured to said supporting surface and is formed to define a passageway to receive one arm of said bar, and including means for restraining pivotal movement of said other arm of said bar about the longitudinal axis of said passageway, whereby a bearing surface of the other arm of said bar will be caused to bear down onto the flange of said track rail.

23. A combination according to claim 22 wherein the passageway extends generally parallel with the length of said track rail.

* * * * *